US005150672A

United States Patent [19]

Fischer et al.

[11] Patent Number: 5,150,672

[45] Date of Patent: Sep. 29, 1992

[54] CYLINDER HEAD OF AN INTERNAL COMBUSTION ENGINE

[75] Inventors: Christof D. Fischer; Wolfgang Petutschnig; Karl Wojik, all of Graz, Austria

[73] Assignee: AVL Gesellschaft für Verbrennungskraftmaschinen und Messtechnik m.b.H. Prof.Dr.Dr.h.c. Hans List, Graz, Austria

[21] Appl. No.: 846,045

[22] Filed: Mar. 5, 1992

[30] Foreign Application Priority Data

Mar. 12, 1991 [AT] Austria ..... A545/91

[51] Int. Cl.[5] ..... F01L 1/26

[52] U.S. Cl. ..... 123/90.22; 123/90.27

[58] Field of Search ..... 123/90.22, 90.23, 90.27, 123/90.39, 90.41, 90.43

[56] References Cited

U.S. PATENT DOCUMENTS 3,613,647 10/1971 Mettig ..... 123/90.22
4,327,677 5/1982 Vander Bok ..... 123/90.22
4,343,268 8/1982 Stang et al. ..... 123/90.22
4,534,324 8/1985 Deutschmann et al. ..... 123/90.22
4,739,734 4/1988 Honda et al. ..... 123/90.22
4,924,821 5/1990 Teerman ..... 123/90.22

FOREIGN PATENT DOCUMENTS 3743854 7/1989 Fed. Rep. of Germany .

*Primary Examiner*—E. Rollins Cross
*Assistant Examiner*—Weilun Lo
*Attorney, Agent, or Firm*—Watson, Cole, Grindle & Watson

[57] ABSTRACT

Cylinder head of an internal combustion engine with more than two valves in overhead arrangement for each cylinder, which are actuated via rocker arms, each rocker arm being individually supported on the cylinder head by means of a bridge. A compact design is achieved by providing a valve bridge for actuation of every two valves of identical function, which valve bridge is attached to the bridge. At least one of the two rocker arms per cylinder acts on a valve bridge supported by the bridge, the pivots of the rocker arms having different distances from the center plane of the cylinder.

3 Claims, 3 Drawing Sheets

CYLINDER HEAD OF AN INTERNAL COMBUSTION ENGINE

BACKGROUND OF THE INVENTION

The invention relates to the cylinder head of an internal combustion engine with more than two overhead valves for each cylinder, which valves are actuated by rocker arms, each rocker arm being individually supported on the cylinder head by means of a bridge.

DESCRIPTION OF THE PRIOR ART

In the German Laid-Open No. 37 43 854 a cylinder head for an internal combustion engine is described, in which the rocker arms are pivoted in a camshaft cover. The two exhaust valves are actuated by separate rocker arms in this known type of cylinder head. For the two intake valves a joint forked rocker arm is provided.

Such an arrangement necessitates central positioning of the camshaft, in the area of the plane connecting the cylinder axes. As a result, the engine will have a certain height, which may be a problem in models specifying a flat engine hood. Another disadvantage of the known type of cylinder head is the large number of different components involved, making production and storage more difficult. In addition, forked rocker arms have proved to be problem-ridden in practical use.

SUMMARY OF THE INVENTION

It is an object of the invention to design a cylinder head of great compactness, using a maximum number of identical components. Above all, construction height should be minimized.

In the invention this is achieved by providing two rocker arms for each cylinder, one of which at least acts on a valve bridge actuating two valves of identical function, and further by providing that at least one valve bridge be supported by the bridge, and that the pivots of the rocker arms have different distances from the center plane of the cylinder.

It is a particular advantage of the invention that even with valves that are not arranged parallel to the axis of the engine center plane, identical rocker arms can be used as the pivot for each of these arms may be determined individually. As no rocker arm shaft is required the design of the cylinder head may vary with the individual needs. Due to the low-lying camshaft in the cylinder head the construction height of the engine may be kept very low. In particular, the camshaft drive gear, which normally rises high above the cylinder head, may be prevented from rising beyond the contour of the valve cover.

As the valve bridge is attached to the bridge no special valve bridge guide is needed between the valves, which has always been a technical problem for lack of space.

The assembly is made largely maintenance-free by providing an element for automatic compensation of the valve clearance. This compensating element is best integrated into the rocker arm bearing element.

In another preferred variant of the invention the proposal is put forward that the elements for automatic compensation of the valve clearance be provided in the valve bridge. In this way proper valve clearance is guaranteed even if the setting of the valves is not uniform.

BRIEF DESCRIPTION OF THE DRAWINGS

Following is a more detailed description of the invention as illustrated by the attached drawings, in which FIG. 1 gives a view from above of a cylinder head as described by the invention, FIG. 2 gives a section along line II—II in FIG. 1, and FIG. 3 gives another variant as a section corresponding to that of FIG. 2.

DETAILED DESCRIPTION OF THE PREFERRED EMBODIMENTS

Figure 1:
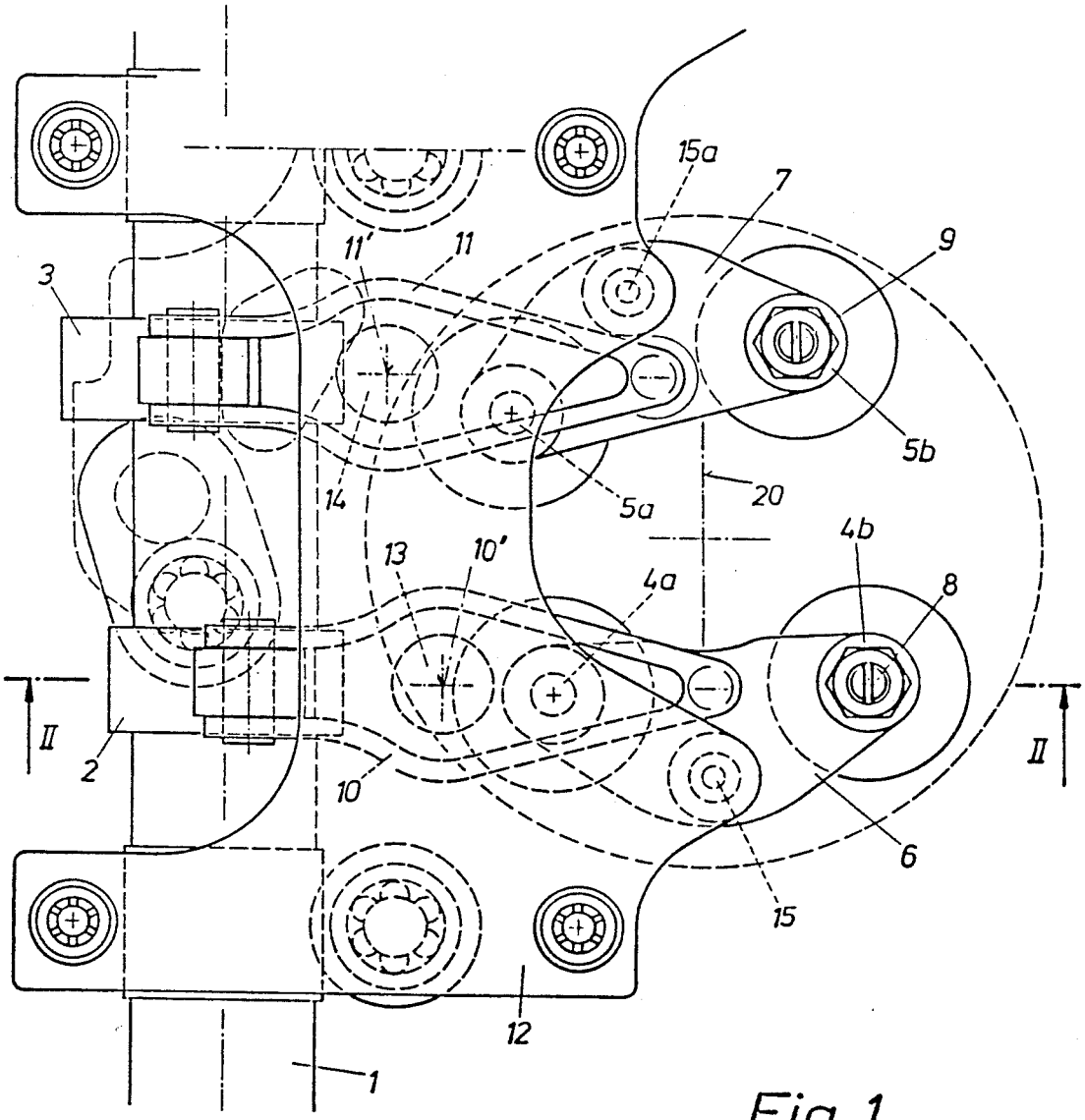
Figure 2:
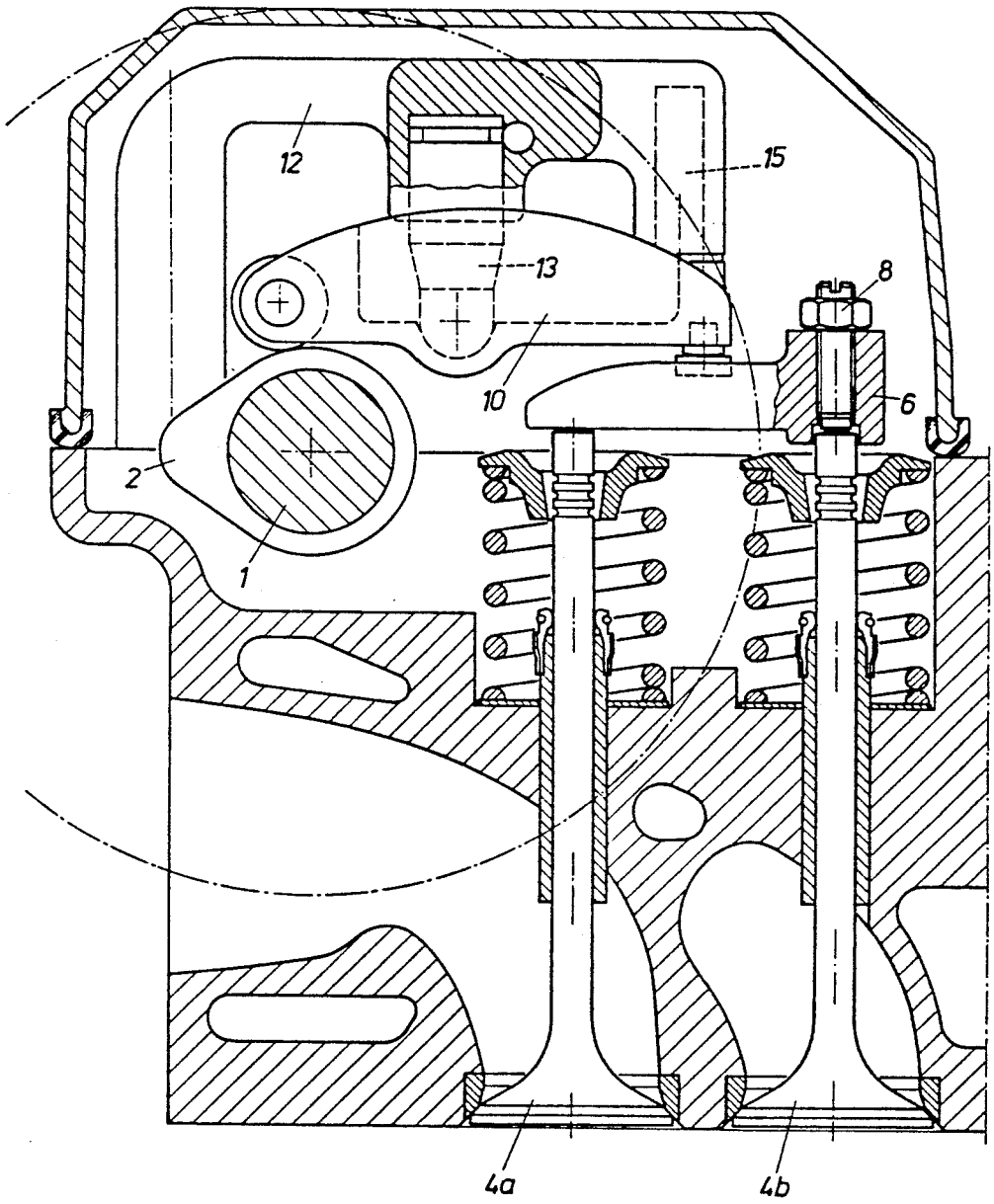

At one side of the cylinder head a camshaft 1 is provided which carries the inlet cam 2 and the exhaust cam 3. The cylinder head contains two intake valves 4*a*, 4*b* and two exhaust valves 5*a*, 5*b*, in valve-in-head arrangement. The intake valves 4*a* and 4*b* are connected by a valve bridge 6. Correspondingly, a valve bridge 7 is provided for the exhaust valves 5*a* and 5*b*. Valve adjustment is effected by means of a screw and nut 8 on the valve bridge 6, and a screw and nut 9 on the valve bridge 7, respectively.

Actuation of the intake valves 4*a* and 4*b* is effected by a rocker arm 10. For the exhaust valves 5*a* and 5*b* a rocker arm 11 is provided. The rocker arms 10 and 11 are supported on pivots 10' and 11' by a bridge 12 into which hydraulic elements 13 and 14 are integrated for compensation of the valve clearance, their distances from the cylinder center plane 20 not being the same. The valve bridge 6 is suspended from the bridge 12 by means of a pin 15. In the same way a pin 15*a* is used for holding the valve bridge 7.

Figure 3:
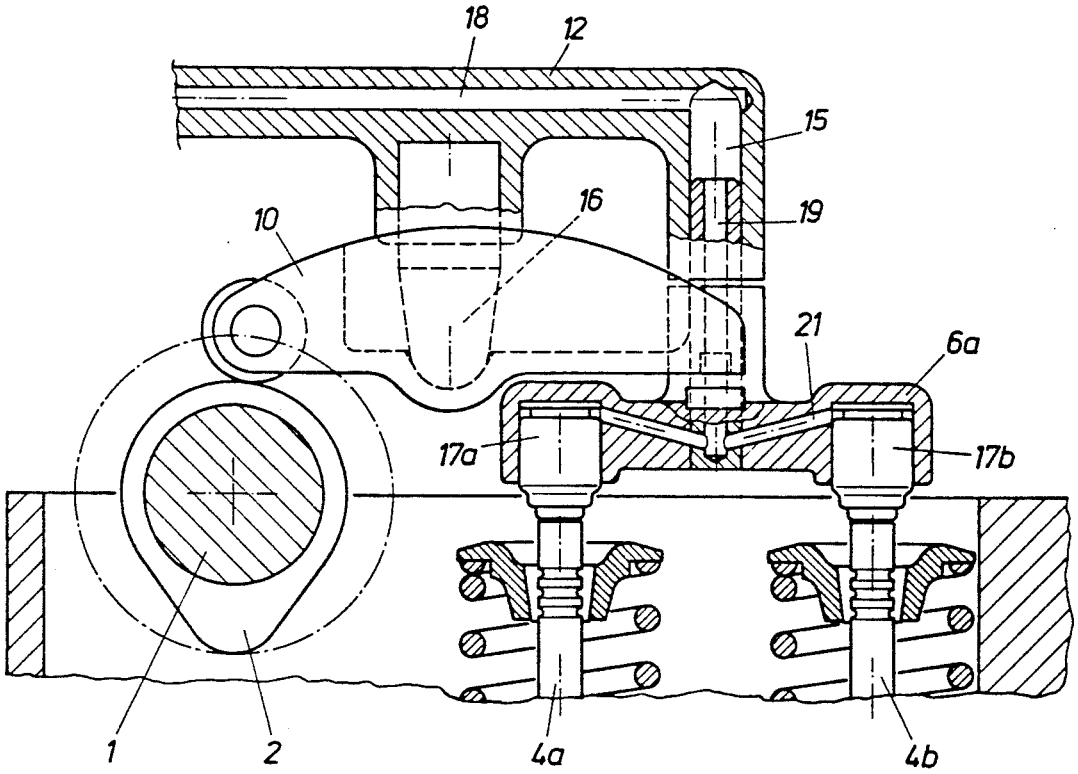

In the variant of FIG. 3 the rocker arm 10 is supported on the bridge 12 by a connecting piece 16. Into the valve bridge 6*a* elements 17*a* and 17*b* are integrated for compensation of the valve clearance of valves 4*a* and 4*b*. The compensating elements 17*a* and 17*b* are supplied with oil from oil passages 18 in the bridge 12, oil passages 19 in the pin 15 and oil passages 21 in the valve bridge 6*a*.

We claim:

1. Cylinder head of an internal combustion engine, comprising two rocker arms for each cylinder, each of said rocker arms having a pivot being individually supported on said cylinder head by means of a bridge, wherein at least one of said rocker arms acts on a valve bridge actuating two overhead valves of indentical function, wherein said at least one valve bridge is suspended by said bridge, and wherein said pivots of said rocker arms have different distances from a center plane of said cylinder.

2. Cylinder head according to claim 1, wherein said bridge is provided with an element for automatic compensation of the valve clearance.

3. Cylinder head according to claim 1, wherein elements for automatic compensation of the valve clearance are provided in said valve bridge.

* * * * *